United States Patent [19]

Savonuzzi

[11] 4,221,540

[45] Sep. 9, 1980

[54] BLADED ROTOR FOR A CENTRIPETAL TURBINE

[76] Inventor: Giovanni F. Savonuzzi, Strada S. Brigida 44, Moncalieri (Turin), Italy

[21] Appl. No.: 946,917

[22] Filed: Sep. 28, 1978

[51] Int. Cl.[3] ..... F01D 5/18; F01D 5/28; F01D 5/30

[52] U.S. Cl. ..... 416/97 R; 416/183; 416/214 A; 416/241 B

[58] Field of Search ..... 416/183, 241 B, 214 A, 416/214 R, 218; 415/120

[56] References Cited

U.S. PATENT DOCUMENTS

| | | | |
|---|---|---|---|
| 3,042,366 | 7/1962 | Holmquist | 416/241 |
| 3,746,469 | 7/1973 | Mason | 416/214 |
| 3,943,703 | 3/1976 | Kronogard | 416/214 A |
| 4,011,737 | 3/1977 | Kruger et al. | 416/241 B |
| 4,125,344 | 11/1978 | Tiefenbacher | 416/183 |

FOREIGN PATENT DOCUMENTS

| | | | |
|---|---|---|---|
| 1017320 | 10/1957 | Fed. Rep. of Germany | 416/241 B |
| 879755 | 3/1943 | France | 416/214 A |
| 976790 | 3/1951 | France | 416/214 |
| 664986 | 1/1952 | United Kingdom | 416/241 B |

*Primary Examiner*—Everette A. Powell, Jr.
*Assistant Examiner*—A. N. Trausch, III
*Attorney, Agent, or Firm*—Sughrue, Rothwell, Mion, Zinn and Macpeak

[57] ABSTRACT

A centripetal turbine rotor has ceramic blades with integral blade roots of arcuate axial section which are clamped axially between two supporting elements mounted on a common shaft so that the ceramic blade roots are maintained in compressive stress along their arcuate, radially inwardly convex, profiles, opposing centrifugal strain in the blade roots.

Cooling air may be supplied along axial channels in one hub to an internal chamber within the blade roots and may thence flow outwardly into the gases flowing through the turbine.

16 Claims, 10 Drawing Figures

BLADED ROTOR FOR A CENTRIPETAL TURBINE

This invention relates to bladed rotors for use in centripetal turbines of gas turbine engines.

In particular the invention relates to bladed rotors of the type comprising a metallic support structure coaxial with the axis of the rotor and a row of blades of ceramic material each having a blade part of aerodynamic profile and an attachment root by which it is anchored to the metallic support structure.

Ceramic blades are capable of withstanding temperatures higher than those to which known blades of metal alloy can be used. The use of ceramic turbine blades therefore increases the maximum temperature of operation of a gas turbine beyond the working temperature of a conventional turbine, thereby increasing the thermodynamic efficiency of the turbine.

The main disadvantage of a ceramic turbine blade compared with a metal blade, however, is the reduced tensile strength of the ceramic blade, which is in general insufficient to resist the stresses resulting from centrifugal forces on the blade during rotation of the turbine rotor.

It has already been proposed, for example in U.S. Pat. No. 3,042,366, to provide an axial flow gas turbine rotor with ceramic blades enclosed in a ring which surrounds the outer ends of the blades, so that in operation of the turbine the blades are urged by centrifugal force against the ring, causing the blades to be subjected to compressive rather than tensile stress. Such a rotor is complicated and therefore expensive to manufacture and is prone to unreliability.

An object of the present invention is to provide a bladed rotor of the centripetal or radial flow type in which the blades are subjected in use to stresses which are mainly compressive, without the need of a complicated and expensive rotor structure.

With this object in view this invention provides a bladed rotor for a centripetal turbine of the type comprising a row of blades of ceramic material, each having a blade part of aerodynamic profile and an attachment root anchored to metallic supporting structure, characterised in that: the attachment root of each blade has an arcuate profile in axial section which is convex towards the axis of rotation of the rotor, the end surfaces of the root being substantially perpendicular to the median line of said arcuate profile, and in that the blade supporting structure comprises two axially spaced apart supporting elements displaceable axially relative to each other and having annular supporting surfaces coaxial with the axis of the rotor, between which the blades are interposed, with opposite end surfaces of the blade roots in contact with said two supporting surfaces, and including means for drawing the two supporting elements axially towards each other to clamp the blade roots between the two annular supporting surfaces so as to apply to the roots compressive forces directed substantially along said median lines of the arcuate profiles of the roots.

In the rotor of this invention the stresses produced by centrifugal forces on each blade in operation of the rotor generate, in each transverse section of the root, in planes perpendicular to said central line, predominantly compressive forces directed along said line, which unload on said supporting surfaces. The roots of the blades behave therefore as arched structures, transmitting to the supporting elements the forces acting on the intermediate unsupported portions.

The compressive forces applied to the roots of the blades by the drawing together of the two supporting elements cause compressive stresses in the aerodynamically profiled parts of the blades, which helps to reduce in such parts the flexural stresses due, in use of the turbine, to centrifugal forces. This effect is particularly important having regard to the fact that in the blades of a centripetal turbine rotor the ratio of the radial dimension to the axial dimension of each blade is considerably less than the corresponding ratio for blades of the axial flow turbine rotors.

The invention will be further described, by way of example, with reference to the accompanying schematic drawings, given by way of non-limiting example, in which.

Figure 1:
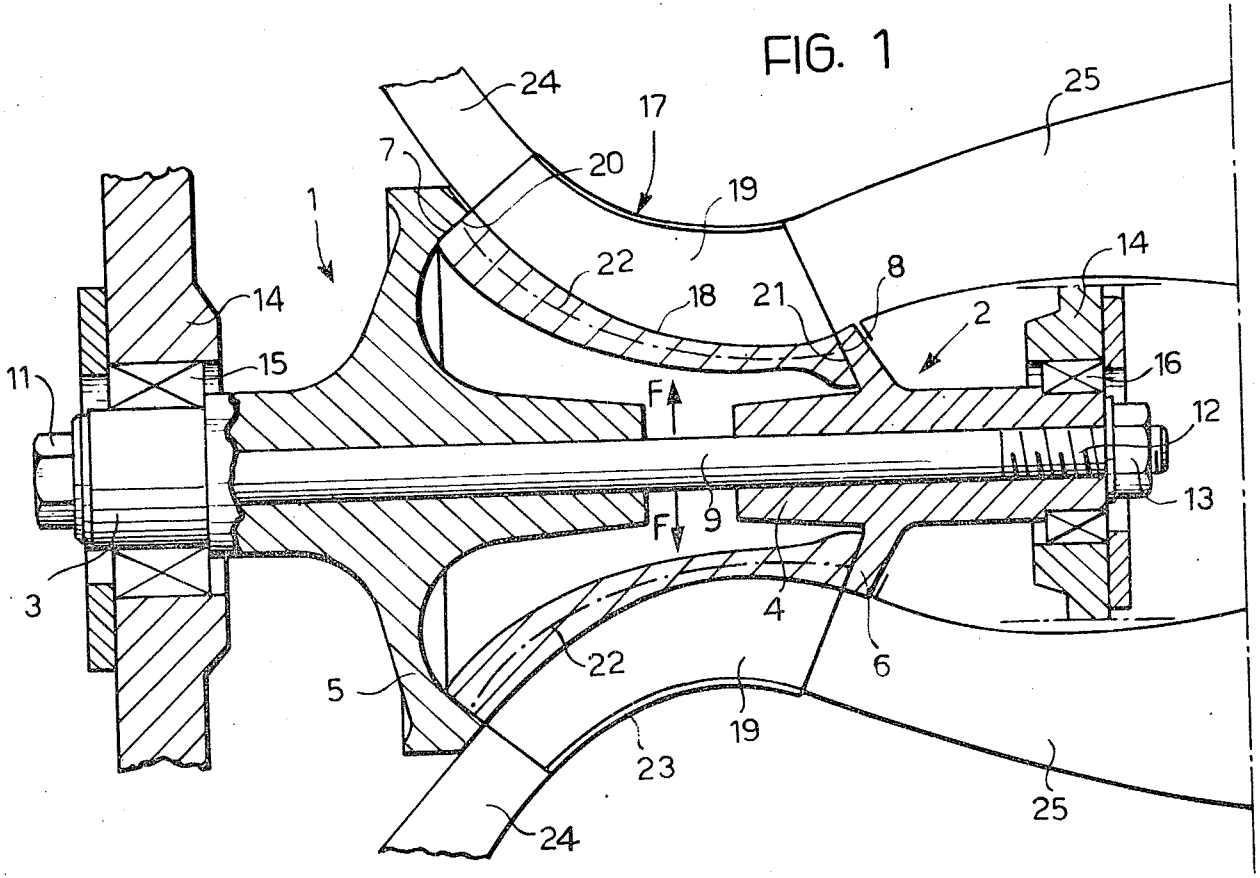
FIG. 1 is an axial section of a bladed rotor according to one embodiment of the invention, for use in a centripetal flow turbine in a gas turbine plant.
Figure 2:
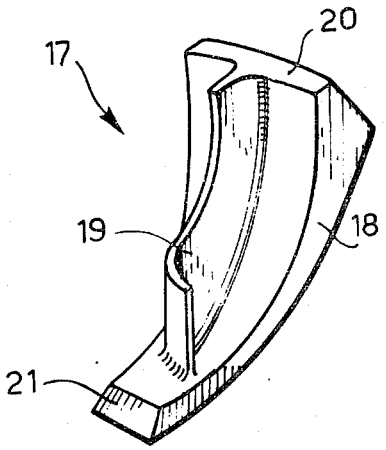
FIG. 2 is a perspective view of one of the blades of the turbine illustrated in FIG. 1.

In the bladed rotor illustrated in FIGS. 1 and 2, reference numerals 1 and 2 indicate two metal supporting elements, in the form of coaxial rotary bodies spaced apart axially. The supporting element 1 and 2 comprises respective hubs 3, 4 and respective discs 5 and 6 extending radially from the hubs.

The discs 5 and 6 have enlarged outer peripheral portions formed with respective annular surfaces 7 and 8 facing each other. The two annular surfaces 7 and 8 are inclined to each other in planes passing through the rotor axis and converging in a radially outward direction (FIG. 1).

Each of the hubs 3 and 4 has an axial cylindrical bore through which a common cylindrical shaft 9 passes. The shaft 9 carries at one end a head 11 which abuts the outer end face of the hub 3. The opposite end of the shaft 9 has an external screw thread 12 on which a nut 13 is threaded, the nut 13 bearing against the adjacent end face of the hub 4.

The axially outside ends of the two hubs 3 and 4 are formed with annular seats for bearings 15 and 16. The structure formed by support elements 1 and 2 and the shaft 9, forms the rotor of a turbine and is supported rotatably by a fixed structure indicated schematically and partially by 14.

A number of blades 17 of ceramic material arranged in an annular array are clamped tightly between the two elements 1 and 2. Each of the blades 17 comprises an attachment root 18 which has in axial section an arcuate profile which is convex towards the axis of rotation of the rotor and a bladed part 19 having an aerodynamic profile.

The attachment root 18 has two end faces 20 and 21 which are substantially perpendicular to the median line 22 of the arcuate profile of the root 18. The end faces 20 and 21 of the attachment root 18 abut the annular surfaces 7 and 8 of the two supporting elements 1, 2.

The turbine blades 17 rotate within a fixed duct, indicated diagrammatically by reference numeral 23.

By tightening the nut 13 on the screw thread 12 of the shaft 9 the attachment roots 18 of the row of blades 17 are clamped between the two supporting annular surfaces 7, 8 thereby applying to these roots compression forces directed substantially along the said median line 22 of their arcuate profile.

The bladed parts 19 of the blades 17 have a radial inlet portion to which, during operation of the turbine, hot gases are fed through an inlet duct 24 and a substantially axially extending discharge portion from which gases are discharged into an outlet duct 25.

In operation of the turbine the stresses produced by centrifugal forces, acting in the direction of the arrows F in FIG. 1 on each blade 17, generate, in each transverse section of the blade root 18 taken in a plane perpendicular to the median line 22, stresses which are predominantly compressive and directed along said medial line. These stresses are transmitted to the supporting annular surfaces 7, 8, so that the blade roots 18 behave like arched structures, capable of unloading on the two end support surfaces 7 and 8 the forces on the unsupported central parts of the blade roots.

The compression forces applied by the annular supporting surfaces 7 and 8 of the elements 1 and 2 to the blade roots 18 also give rise to compressive stresses in the profiled blade parts 19, helping to reduce the flexural stress in these parts due to centrifugal forces in the use of the turbine. Because each blade part 19 has an aerodynamic profile with an axial dimension much less than its radial dimension the residual tensile stress acting on the part 19 in use of the rotor according to the invention is reduced to more than bearable values.

The blades 17 can be simply made by pressure forming due to the absence of undercuts.

Figure 3:
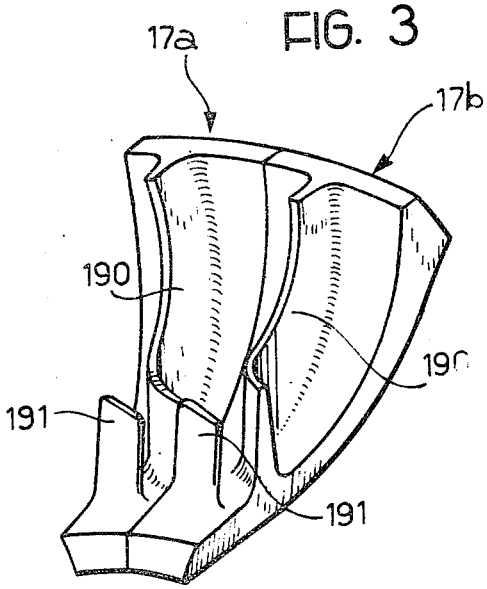
FIG. 3 is a variant of FIG. 2.

In the variant illustrated in FIG. 3 two adjoining blade segments 17*a* and 17*b* are shown in which the aerodynamic profile of each blade has a considerable axial extent. In this case each adjacent pair of blade segments 17*a*, 17*b* has a radially outer blade portion 190 and a radially inner portion 191 such that when the two blade portions 190, 191 are abutted axially the outer blade portion 190 of one segment 17*a* forms a continuation of the inner blade portion 191 of the adjoining segment 17*b*.

Figure 4:
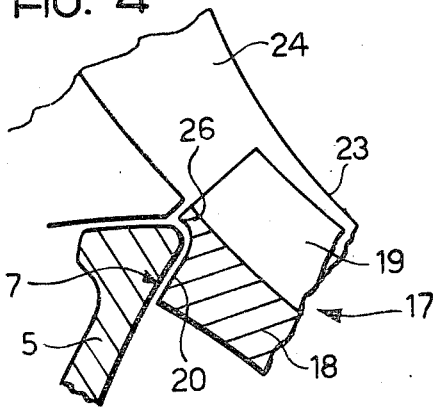
FIG. 4 is a fragmentary axial section on an enlarged scale of a variant of the bladed rotor shown in FIG. 1.

FIG. 4 illustrates a variant in which, in order to protect the outer edge of the disc 5 of the rotor from the hot gases the root 18 of each blade 17 is formed with a lip 26 which covers the outer edge of the disc 5.

Figure 5:
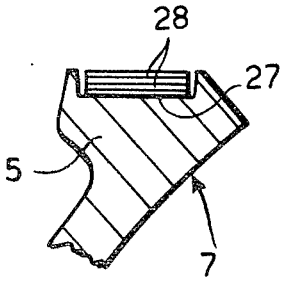
FIGS. 5 and 6 are fragmentary axial sections, on a yet further enlarged scale, illustrating further variants of the rotor shown in FIG. 1.

In the variant illustrated in FIG. 5 the edge of the disc 5 is formed with a circumferential channel 27 which receives one or more flat hoop-like layers 28 which in use of the turbine are under tensile stress to resist the stresses in the disc 5 due to centrifugal forces. The layers 28 may be metallic or may comprise fibres of high tensile strength such as carbon or boron fibres.

Figure 6:
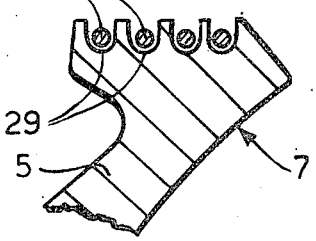

Alternatively, as illustrated in FIG. 6, the disc 5 may have a number of peripheral grooves 29 in which individual hoop-like filaments 30 of high tensile strength are seated.

Figure 7:
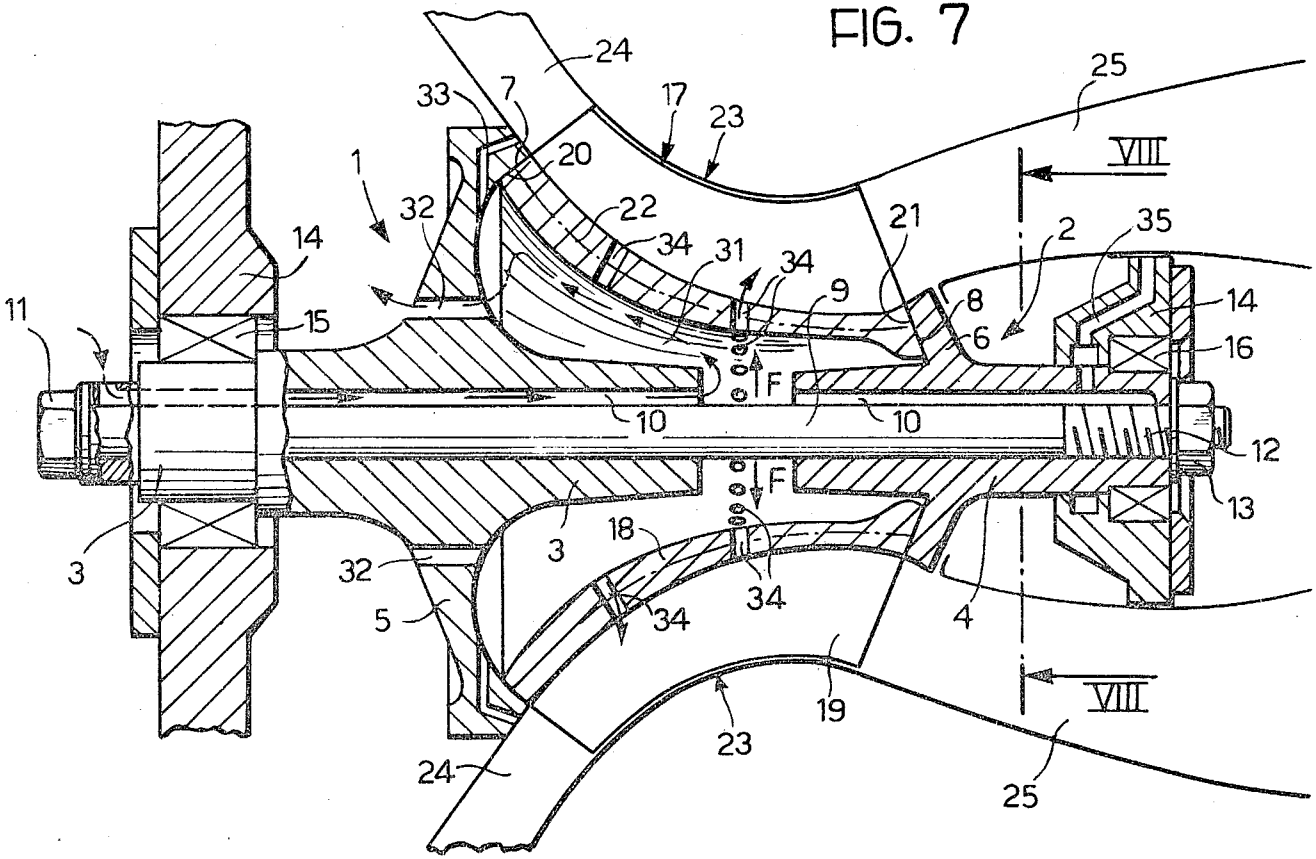
FIG. 7 is an axial section of a bladed rotor according to another embodiment of the invention.

The bladed turbine rotor illustrated in FIG. 7 has the same general structure as that illustrated in FIG. 1 and differs from it only in the provision of internal ducts for the circulation of a cooling fluid (air in this case) within the components of the rotor. For this purpose the hubs 3 and 4 of the two metal supporting elements 1 and 2 have, on the internal surfaces of the axial bores through which the shaft 9 passes, longitudinal grooves 10 spaced apart angularly at regular intervals. A cooling fluid is supplied, by means not shown, to the left hand end (as viewed in FIG. 7), of the grooves 10, passing along these grooves into a chamber 31 defined between the roots 18 of the blades 17 and the facing parts of the two supporting elements 1 and 2.

The shape of the chamber 31 is such that the action of the centrifugal force and the variation of the density of the cooling fluid due to its progressive heating favours a circulation of the fluid in the direction indicated by the arrows. The cooling fluid is discharged from the chamber 31 through passages 32 in the radially inner portion of the disc 5 so as to flow in a closed circulatory path through conduits (not shown) which return the fluid to the inlet (left hand) ends of the grooves 10.

Figure 8:
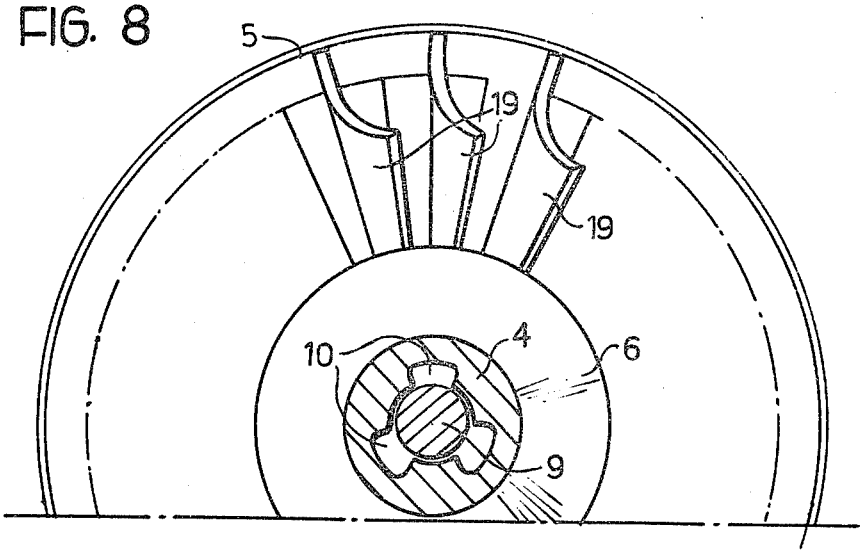
FIG. 8 is a partial transverse section on line VIII—VIII of FIG. 7.

In alternative arrangements, also shown in FIG. 7, the cooling fluid can be discharged radially through radial passages 33 in the peripheral part of the rotor disc 5 to flow into the inlet duct 24 so as to mix with the hot gases flowing into the turbine. The cooling fluid can also be discharged into the gases flowing through the turbine through radial passages 34 in the roots 18 of the blades. The cooling fluid can alternatively flow through the longitudinal grooves 10 in the hub 4 (FIG. 8) so as to cool the shaft bearing 16, the fluid being discharged into the turbine exhaust through radial passages 35 in the support structure 14.

Figure 9:
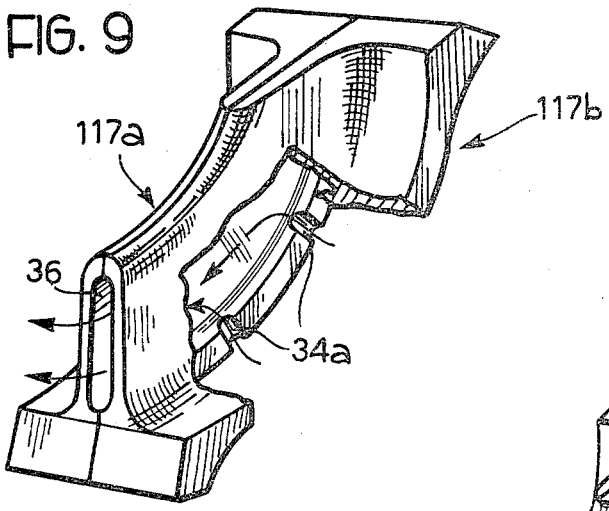
FIG. 9 is a perspective view, partly cut away, of a blade which can be used in the turbine rotor illustrated in FIG. 7.

The turbine blades 17 can be provided with internal cavities, as shown in FIG. 9, to receive the cooling fluid which enters such cavities through passages 34*a* in the blade roots 18. Thus in the construction shown in FIG. 9 an internal cavity is formed in each blade by forming each blade from neighbouring blade segments 117*a* and 117*b* between which an internal cavity is defined from which cooling fluid is discharged through an axially directed end opening 36.

Figure 10:
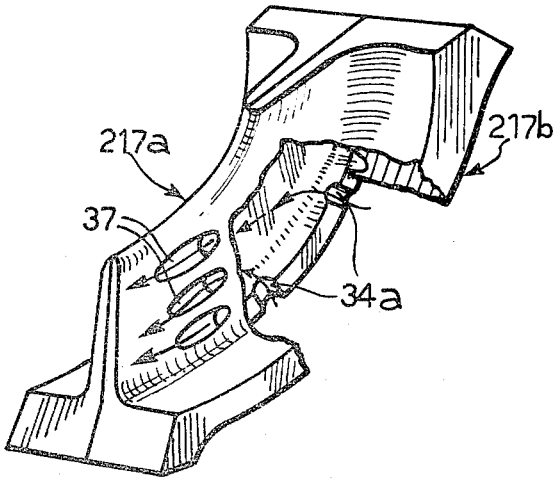
FIG. 10 illustrates a variant of the blade shown in FIG. 9.

In the example illustrated in FIG. 10 each blade is formed by two blade segments 217*a* and 217*b* which define an internal cavity from which the cooling fluid is discharged into the turbine exhaust through openings 37 in the side walls of said cavity.

From the preceding description it will be understood that the turbine rotor according to this invention enables ceramic blades to be employed effectively by being maintained in compression under the action of centrifugal forces in operation of the turbine.

The precompression imparted to the set of blades by the mounting arrangement described furthermore allows the drawbacks arising from the different expansion coefficients of the ceramic parts and of the metal parts to be avoided. It is thus possible to maintain practically constant the mounting forces under any conditions of temperature-induced deformation.

Furthermore as all the components of the rotor are held together by elastic forces applied to the surfaces of contact between the components, giving a substantial vibration-damping effect, which can be enhanced by interposing solid lubricants or suitable low-friction materials between the contact surfaces.

In the examples illustrated the row of ceramic turbine blades consists of a number of blades each of which is moulded singly and anchored to a rotor: the invention also applies, however, to the case in which the attachment roots of the blades are an integral part of a rotary body of ceramic material.

It will be understood that details of manufacture and practical embodiments of the invention can be varied considerably from what has been illustrated and described by way of example, without departing from the principle or scope of this invention.

I claim:

1. Bladed rotor for a centripetal turbine of the type comprising: a metal support structure and a row of blades of ceramic material, each having a blade part of aerodynamic profile and an attachment root anchored to the supporting structure, wherein:

- each blade attachment root has an arcuate profile with an arcuate median line which is convex towards the axis of rotation of the rotor, the root having end surfaces which are substantially perpendicular to said median line,
- the supporting structure comprises two axially spaced apart axially displaceable supporting elements, said supporting elements having annular supporting surfaces coaxial with the axis of the rotor, between which the blades are interposed with the blade root end surfaces in contact with said two supporting surfaces, and means for drawing the two supporting elements axially towards each other to clamp the blade roots between said two annular supporting surfaces so as to apply to the roots compressive forces directed substantially along said median lines of the blade root profiles.

2. A bladed rotor as defined in claim 1, wherein each blade and its associated attachment root is formed as an integral part of a blade segment so shaped as to form with the other blade segments a circumferentially continuous body with symmetry about the rotor axis.

3. A bladed rotor as defined in claim 1, wherein the attachment roots of the blade are part of a common rotational body of ceramic material with which the blades are formed integrally.

4. A bladed rotor as defined in claim 1, wherein each of the supporting elements comprises a hub and a rotor disc extending substantially radially from said hub, said discs being formed with said annular supporting surfaces which face each other, said supporting surfaces being inclined to each other in axial section and converging in a radially outward direction, each of the hubs having an axial bore, and wherein a shaft passes through said hub bores, said shaft having at one end a head which bears against an outer end face of one of the hubs and at its opposite end a threaded portion receiving a nut which reacts against an outer end face of the other hub, whereby screwing of said nut onto the shaft effects clamping of the roots of the blades between the said annular supporting surfaces of the two hubs.

5. A bladed rotor as defined in claim 4, wherein the hub of the supporting element carrying the annular supporting surface which abuts the inlet ends of the blade roots has axial passages for the inflow of cooling fluid, said passages communicating with a chamber defined between two rotor discs and the internal surfaces of the blade roots, and wherein the said chamber has outlet ducts for the outflow of said cooling fluid from said chamber.

6. A bladed rotor as defined in claim 5, wherein the outflow ducts for the cooling fluid are provided in a radially inner part of the rotor disc in which said axial passages for the inflow of the cooling fluid are provided.

7. A bladed rotor as defined in claim 5, wherein the outflow ducts for the cooling fluid are provided in the periphery of the rotor disc in which the inflow passages are formed, to discharge said cooling fluid into a turbine inlet duct upstream of the blades.

8. A bladed rotor as defined in claim 5, wherein each blade has an internal cavity which communicates through passages with said chamber to which the cooling fluid is fed, and including an opening communicating with said internal cavity for the discharge to the outside of the cooling fluid fed to said internal cavity.

9. A bladed rotor as defined in claim 8, wherein each blade comprises two mating elements, the facing internal surfaces of which form said internal blade cavity.

10. A bladed rotor as defined in claim 9, wherein the internal blade cavity communicates with the outside through an outlet opening defined between the two mating elements at the discharge end of the blade.

11. A bladed rotor as defined in claim 9, wherein the side walls of the two elements which form the blade are provided with outlet openings for the discharge of the cooling fluid.

12. A bladed rotor as defined in claim 5, including a fixed support structure rotatably supporting the motor, wherein the hub of the supporting element which abuts the outlet ends of the blade roots also has axial outflow passages for the cooling fluid, said outflow passages communicating with the internal chamber and communicating with the outside via a radial passage in said fixed support structure.

13. A bladed rotor as defined in claim 2, wherein each blade segment of ceramic material is formed with two blade portions of aerodynamic profile spaced from each other, one such portion in one segment forming a continuation of the aerodynamic profile of the other portion of an adjacent blade segment.

14. A bladed rotor as defined in claim 1, wherein at least one of the rotary supporting elements is provided with peripheral bands extending circumferentially.

15. A bladed rotor as defined in claim 1, wherein at least one of the rotary supporting elements is provided with peripheral filaments extending circumferentially.

16. A bladed rotor as defined in claim 1, wherein the blade roots are formed with a lip which extends over the outer peripheral edge of at least one of the supporting elements adjacent the inlet ends of the blades, to protect the said peripheral edge from the action of hot gases.

* * * * *